US005623803A

United States Patent [19]

Willis

[11] Patent Number: 5,623,803

[45] Date of Patent: Apr. 29, 1997

[54] PLASTIC DECKING AND SECUREMENT SYSTEM AND METHOD OF INSTALLATION

[76] Inventor: Mark C. Willis, 4215 Hart Rd., Richfield, Ohio 44256

[21] Appl. No.: 407,715

[22] Filed: Mar. 21, 1995

[51] Int. Cl.[6] ..... E04H 12/02

[52] U.S. Cl. ..... 52/650.3; 52/480; 52/403.1; 52/79.6

[58] Field of Search ..... 52/177, 480, 482, 52/483.1, 665, 669, 650.3, 655.1, 767, 403.1, 79.6, 263

[56] References Cited

U.S. PATENT DOCUMENTS

| | | | |
|---|---|---|---|
| 2,862,255 | 12/1958 | Nelson | 52/403.1 |
| 3,045,294 | 7/1962 | Liverzy, Jr. | 52/403.1 |
| 3,387,422 | 6/1968 | Wanzer | 52/403.1 X |
| 3,389,930 | 6/1968 | Ashworth et al. | 287/189 |
| 3,822,053 | 7/1974 | Daily | 256/22 |
| 3,902,703 | 9/1975 | Bouye | 256/24 |
| 3,921,960 | 11/1975 | Bright | 256/65 |
| 4,026,084 | 5/1977 | Goose | 52/495 |
| 4,108,422 | 8/1978 | Fleischmann | 256/67 |
| 4,138,094 | 2/1979 | Thir | 256/67 |
| 4,140,298 | 2/1979 | Coleman, Jr. | 256/65 |
| 4,477,058 | 10/1984 | Lowery | 256/19 |
| 4,572,694 | 2/1986 | Hoeksema | 403/187 |
| 4,609,185 | 9/1986 | Prater et al. | 256/65 |
| 4,691,484 | 9/1987 | Wilson | 52/79.6 |
| 4,783,040 | 11/1988 | Lindberg et al. | 248/74.3 |
| 4,809,955 | 3/1989 | Veilleux | 256/85 |
| 4,823,529 | 4/1989 | Canfield et al. | 52/263 |
| 4,833,842 | 5/1989 | Anastasio | 52/79.6 |
| 5,230,186 | 7/1993 | Hammond et al. | 52/79.6 |
| 5,274,977 | 1/1994 | Bann | 52/480 |
| 5,275,381 | 1/1994 | Cluff et al. | 256/35 |
| 5,394,667 | 3/1995 | Nystrom | 52/480 |

FOREIGN PATENT DOCUMENTS

| | | | |
|---|---|---|---|
| 1212178 | 3/1960 | France | 52/403.1 |
| 3617020 | 11/1987 | Germany | 52/79.6 |

OTHER PUBLICATIONS

Brochure entitled "Brock Dock" Deck of the Future.

*Primary Examiner*—Christopher T. Kent
*Assistant Examiner*—Yvonne Horton-Richardson
*Attorney, Agent, or Firm*—Roger D. Emerson

[57] ABSTRACT

A deck structure utilizing recycled plastic lumber decking planks which slide onto a rigid frame is provided. The frame includes supporting members having protruding "T"-shaped connectors which selectively fit into preformed grooves on the underside of the plastic planks. The manner in which the planks are secured to the frame allows for the expansion and contraction of the individual plank lengths due to temperature variations. In addition, brackets are provided which fasten railings and the like to the rigid frame.

18 Claims, 4 Drawing Sheets

PLASTIC DECKING AND SECUREMENT SYSTEM AND METHOD OF INSTALLATION

BACKGROUND OF THE INVENTION

1. Field of Invention

This invention pertains generally to the art of deck construction for residential and commercial buildings and more specifically to a securement system for a deck constructed from plastic lumber.

2. Description of the Related Art

Conventional decks around homes, pools, docks and the like are often constructed from pressure-treated wooden decking on top of a treated lumber frame, made of joists, the joists being attached to posts set three to four feet into the ground into a concrete base. The entire structure is used to maintain the structural integrity. The joists hold the decking and the decking keeps the joists from warping.

Constructing a deck from wooden material has some disadvantages. The wood needs to be repeatedly and systematically treated or painted to protect it from the elements. Also, regular maintenance such as stripping and refinishing must be performed in order to keep up the appearance of the deck. Unfortunately, the wood material may still warp, crack, splinter or rot.

Plastic as a building material, and specifically a building material for decks, has the advantages of being able to be colored with coloring agents, being able to be extruded to various configurations, being recyclable, being environmentally friendly, being able to be constructed of recycled materials, not splintering, rotting, or cracking as well as others.

However, plastic has the significant disadvantage of dimensional instability due to daily temperature changes. Previous to the herein disclosed invention, due to temperature variations in the ambient air, decking made of plastic would expand along its extruded length as it warmed and contract as it cooled. The dimensional variation was too great for a deck to be constructed of plastic wood.

Efforts by others to address the challenges raised by using plastic as a building material include U.S. Pat. No. 4,477,058 to Lowery which discloses a fence made of plastic components. The fence can be constructed of plastic fence boards which have holes formed in one side for receiving pegs. Some of the holes are vertical slots to allow the fence boards to be placed at various heights to accommodate uneven terrain. Lowery does not address in any way the problems raised by the thermal dimensional instability of plastic.

U.S. Pat. No. 4,026,084 to Goose discloses a construction system which uses extruded sections, one of which has a channel formed therein. However, Goose appears to be directed to constructions systems for interior office spaces utilizing aluminum connecting components.

U.S. Pat. No. 4,108,422 to Fleischmann discloses an arrangement for supporting railing which includes a T-shaped groove.

However, none of the known prior art discloses a solution to the problem of the thermal dimensional instability of plastic.

The present invention contemplates a new deck construction and securement system which is simple in design, effective in use, and overcomes the foregoing difficulties and others while providing better and more advantageous results.

SUMMARY OF THE INVENTION

In accordance with the present invention, a new and improved deck construction and securement system is provided.

More particularly, in accordance with the invention, the deck construction comprises a rigid frame, which does not rely on the decking material to keep it true and a plastic lumber decking which is slidably secured to a rigid frame.

According to one aspect of the invention, a deck structure comprises a rigid frame of spaced-apart, supporting members; a plurality of planks closely received transversely to the supporting members, each of the planks having a longitudinal groove therein; and, a plurality of connectors protruding from the frame and selectively fitting into the grooves for slidably connecting the planks to the frame.

According to another aspect of the invention, the deck structure comprises means for rigidly securing one end of each plank to the frame.

According to another aspect of the invention, the planks are constructed of man-made materials such as plastic.

According to another aspect of the invention, the planks comprise inwardly extending flange voids on either side of the grooves contained therein.

According to another aspect of the invention, each connector comprises a head, the head being inward of the flange voids to prevent displacement of the plank away from the frame.

According to another aspect of the invention, each connector is "T-shaped", with the cross bar of the connector aligned parallel to the direction of the supporting members.

According to another aspect of the invention, the supporting members are placed approximately 12 inches apart.

According to another aspect of the invention, the supporting members are constructed of corrosion resistant material such as metal or fiberglass.

According to another aspect of the invention, the deck structure comprises brackets which are fixed to the frame at spaced-apart intervals to allow the attachment of a railing.

According to another aspect of the invention, lumber for use in a decking system comprises plastic material with a longitudinal groove therein and inwardly extending flange voids on either side of the groove.

According to another aspect of the invention, a connector for use in a decking system and protruding from a supporting frame comprises a head portion for slidably attaching plastic lumber without permitting displacement of the plank from the frame.

One advantage of the present invention is the time saved during installation. Because the decking planks can be extruded to their finished lengths, joints, and the accompanying measuring and cutting, can be eliminated. Also, the method of installation allows each plank to be quickly installed by sliding it into place on the frame.

Another advantage of the present invention is its convenience. The plastic decking can be colored with coloring agents during its extrusion. The coloring agents can be chosen to match the color of the associated structure, for example a house. The decking therefore does not need to be pre-treated or painted, nor does it require stripping and refinishing to maintain is appearance.

Another advantage of the present invention is its durability. The plastic decking will not warp, crack, splinter or rot over time.

Another advantage of the present invention is its use of recycled plastic which is an environmentally friendly construction material.

Still other benefits and advantages of the invention will become apparent to those skilled in the art upon a reading and understanding of the following specification.

BRIEF DESCRIPTION OF THE DRAWINGS

The invention may take physical form in certain parts and arrangement of parts. A preferred embodiment of these parts will be discussed in detail in the specification and illustrated in the accompanying drawings, which form a part of this disclosure and wherein.

DESCRIPTION OF THE PREFERRED EMBODIMENT

Figure 9:
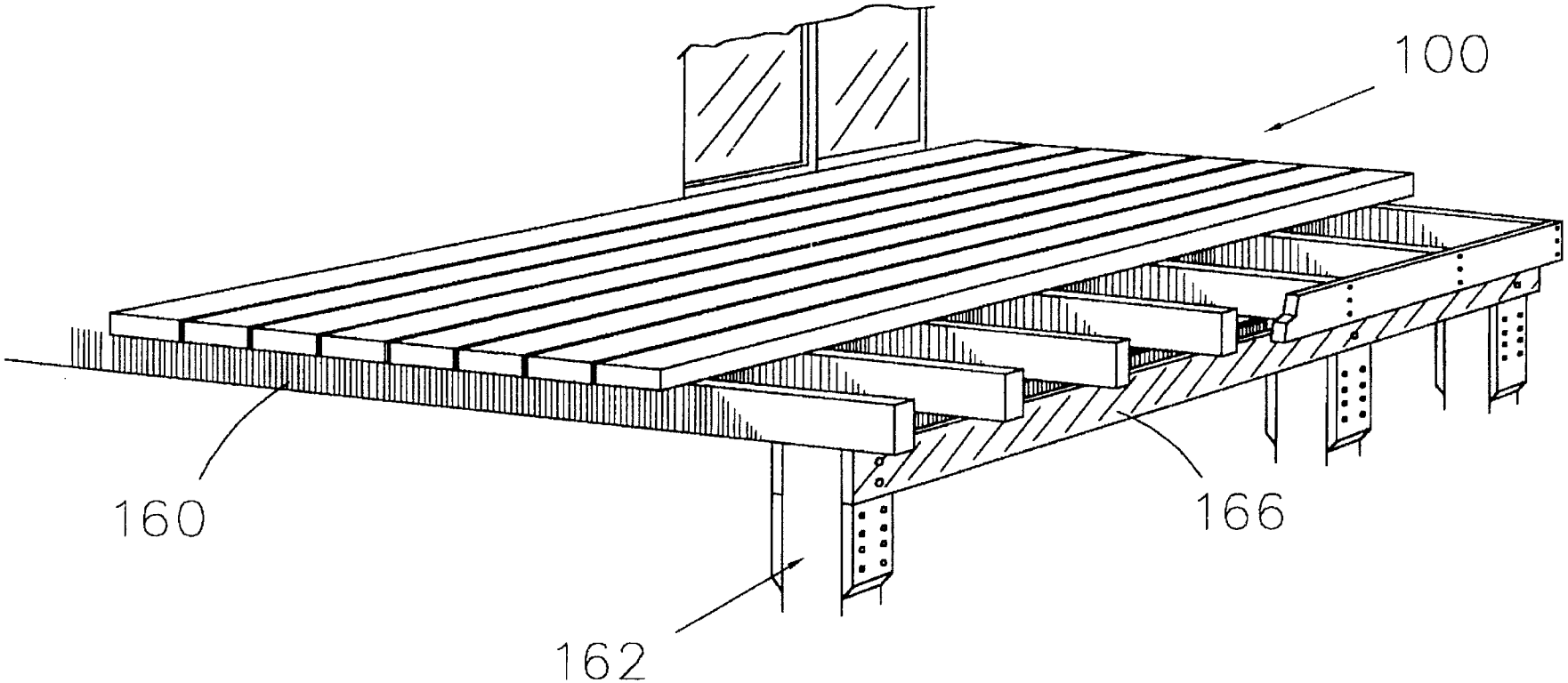
FIG. 9 is a perspective view of a typical prior art wood deck.

Referring now to the drawings, which are for purposes of illustrating a preferred embodiment of the invention only, and not for purposes of limiting the invention, FIG. 9 illustrates a prior art wooden deck 100, such as might be attached to a residential home or commercial establishment. The deck 100 is comprised of joists 160, posts 162, and beams 166. The invention is similar to a prior art wooden deck, but uses components made of plastic lumber instead of wooden components.

Figure 1:
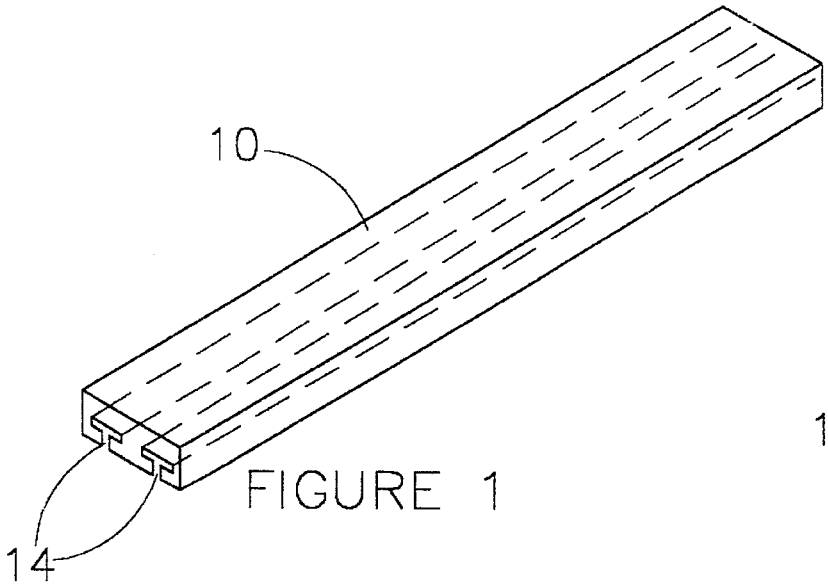
FIG. 1 is a perspective view of a plastic lumber plank according to the invention.

For example, with reference to FIG. 1, a plastic lumber plank 10 according to the invention can be extruded to such a length as to eliminate the need for joints in the deck construction. This represents one advantage over wood decking, since wood planks must be butt-spliced, creating a joint. It may also extruded with a textured non-slip surface or one that has a decorative pattern such as geometric shapes or wood grain.

One or more longitudinal grooves 14 are formed in the underside 12 of the plank 10. The longitudinal grooves 14 in the plank 10 further includes inwardly extending flange voids 18 on either side of the groove 14. In a preferred embodiment, each plank 10 would be ¾ inches thick and 5 ½ inches wide and contain two longitudinal grooves 14 therein.

Figure 2:
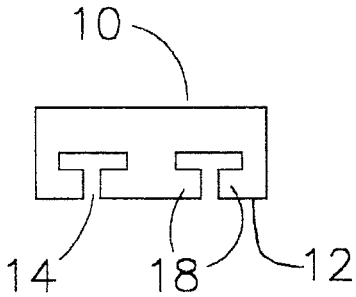
FIG. 2 is an end view of the plank of FIG. 1.

With reference to FIG. 2, a preferred embodiment of the plank 10 comprises two parallel longitudinal grooves 14. The inwardly extending flange voids 18 give the longitudinal grooves 14 "T"-shaped cross-sectional configuration.

Figure 3:
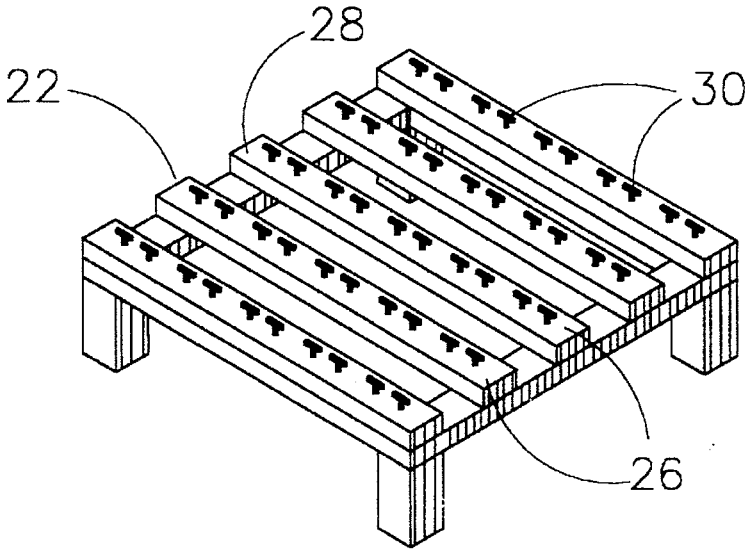
FIG. 3 is a perspective view of a rigid frame according to the invention.

With reference to FIG. 3, a perspective view of the rigid frame 22 according to the invention is illustrated. As in conventional deck construction, the frame 22 rests on posts which are secured into the ground. The frame 22 comprises rigidly secured, spaced-apart supporting member 26. The frame 22 forms an independent rigid structure. The frame 22 may comprise wooden joists which are rigidly held by cross bracing (not shown). In the preferred embodiment, the frame 22 comprises weather-resistant, corrosion-resistant metal such as aluminum, galvanized steel, stainless steel and the like which is rigidly joined together. In this way, a frame 22 is constructed which does not rely upon the decking material to achieve structural rigidity. In a preferred embodiment, the supporting members are spaced approximately 12 inches apart, rather than the 16 inches to 24 inches as in conventional deck construction, to give proper support to the plastic planks 10.

Figure 4:
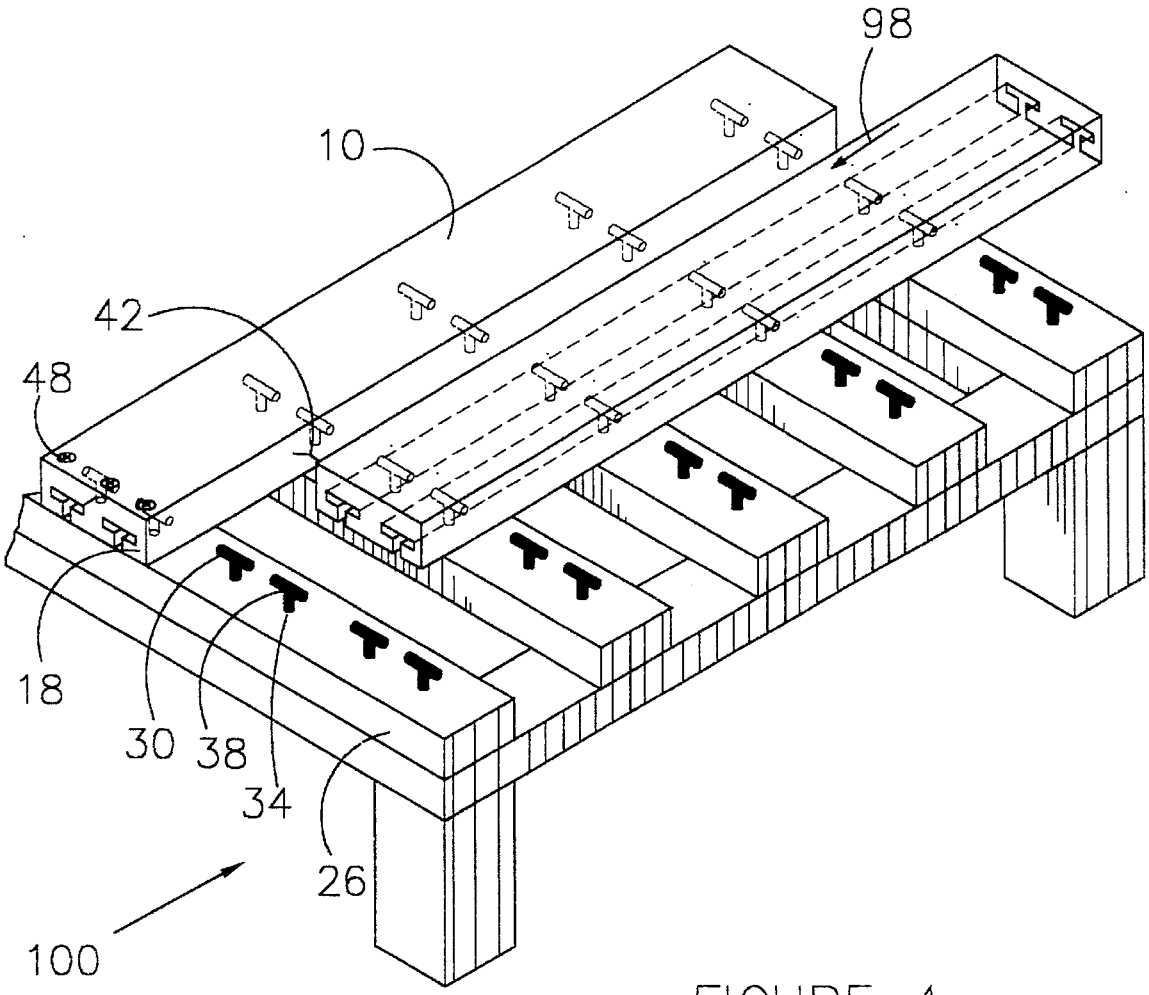
FIG. 4 is a perspective view of a supporting member with attached connectors and associated planks.

With reference to FIGS. 3 and 4, protruding from an upper surface 28 of the supporting members 26 are connectors 30. The connectors 30 serve to slidably secure the planks 10 to the frame 22. The connectors 30 are preferably made of a weather-resistant, corrosion-resistant metal. Also, connectors 30 may be formed of metal having a corrosion-resistant coating thereon.

As shown in FIG. 4 each connector 30 has a base portion 34 and a head portion 38. The connectors 30 have a cross-sectional configuration essentially the same as the longitudinal grooves 14 along with the flange voids 18, although the connectors 30 are slightly smaller to facilitate the sliding of the planks 10 over the connectors 30. The head portion 38 of the connector 30 is located inward of the extending flange voids 18 of the plank 10 to allow the plank 10 to be slidably secured to the support member 26 without allowing displacement of the plank 10 away from the supporting member 26. In a preferred embodiment, the connectors 30 are "T"-shaped. The base 34 of the connector 30 is fixed to the supporting members 26. In one embodiment, the connector 30 has a T-shaped cross-section. The head portion 38 includes a cross-bar 39 which is arranged parallel with the supporting members 26. As best shown in FIG. 4, the base 34 of connector 30 extends normally from supporting member 26. Each connector 30 is received within a groove 14 so that the head portion 38 cooperates with flanges 18 to prevent vertical displacement of plank 10 while allowing movement of the planks relative to the frame 22 in a direction parallel to the longitudinal groove 14.

The configuration of the connectors 30 and the planks 10 enable a deck 100 according to the invention to have all of the benefits of a plastic decking material without the drawbacks which previously made plastic unsuitable for this application. Plastic as a building material, and specifically a building material for decks, has the advantages of not rotting, splintering or corroding due to weather, being able to be colored with coloring agents, being able to be extruded to various configurations, being recyclable, being environmentally friendly, being able to be constructed of recycled materials, as well as others.

However, plastic also has previously has the significant disadvantage of dimensional instability due to temperature changes. Previous to the herein disclosed invention, due to daily temperature variations in the ambient air as the seasons changed, decking made of plastic and securely fastened together would warp too greatly for a deck to be constructed.

With continuing reference to FIG. 4, in the inventive deck 100, the decking planks 10 are placed transversely to the supporting members 26. As can been seen in FIG. 4, the planks 10 slide over the protruding connectors 30 in the direction indicated by the arrow 98. The connectors 30 on each supporting member 26 are spaced to allow a small gap 42 to be formed between adjacent planks 10.

The slidable manner in which the planks 10 are connected to the frame 22 accommodates and allows for the dimensional instability of the plastic planks 10. For instance, over an approximate 12 foot length, the plank 10 may expand or contract 2 inches in length during the course of a day due to temperature variations. Rigidly attaching the plank 10 to the frame 22, such as through prior art nailing techniques would generate tensile forces as the planks 10 tried to respond to the rising temperature by stretching. Being unable to simple lengthen, and being constrained by natural laws to grow, the planks 10, would buckle and the frame, would warp.

According to the invention, a rigid frame 22 is built and the planks 10 are secured in such a way as to allow the unhindered expansion and contraction of the planks 10 along their lengths. In a preferred embodiment, one end of the plank 10 is rigidly secured to a supporting member 26 with securing means 48. While any securing means 48 can be used which is chosen with good engineering judgment, the preferred securing means 48 is a screw. Securing only one end of the plank 10 provides sufficient securement while allowing expansion or contraction along the length of the plank 10. The securing means 48 is used at the end of the plank 10 where movement is least desirable, with any displacement therefore occurring at only the opposite end of the plank 10.

Figure 5:
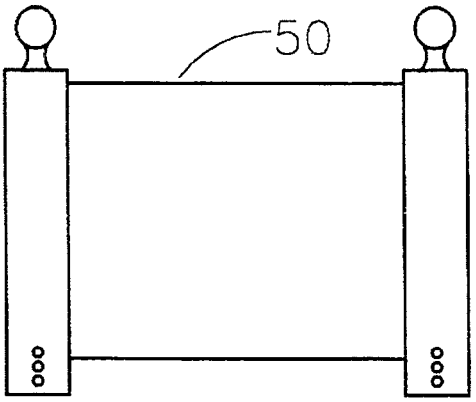
FIG. 5 is a first rail embodiment according to one embodiment of the invention.
Figure 6:
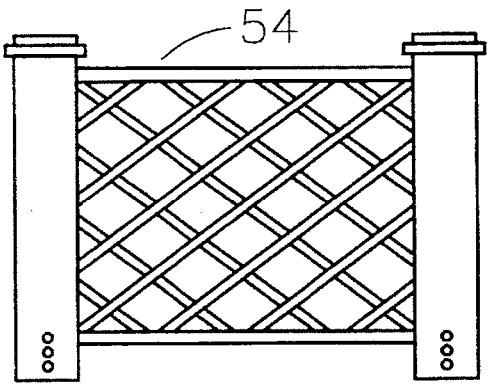
FIG. 6 is a second rail embodiment according to one embodiment of the invention.

The process and elements described above can be further configured into related articles. For example, with reference to FIGS. 5 and 6, two embodiments 50 and 54 of railing type structures that may be used to complete the deck structure are illustrated.

Figure 7:
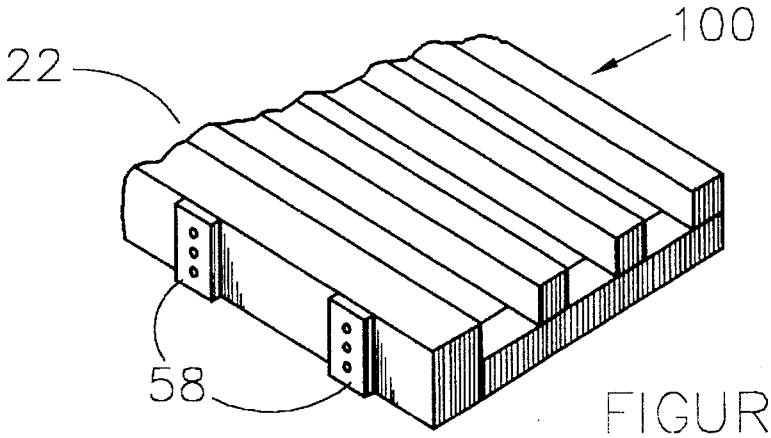
FIG. 7 is a partial view of the frame of FIG. 3 with rail brackets.

FIG. 7 shows brackets 58 used in the preferred embodiment to secure railing structures 50, 54 or the like to the rigid frame 22.

Figure 8:
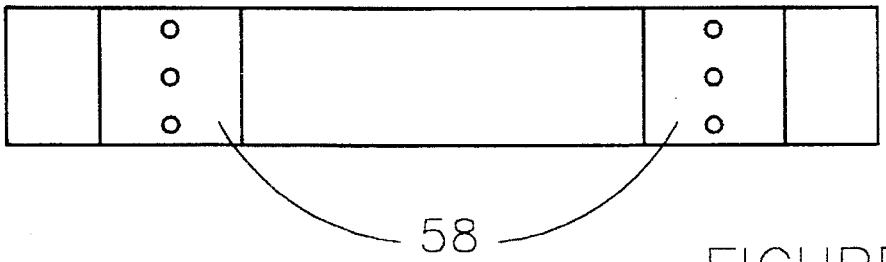
FIG. 8 is an end view of the brackets of FIG. 5.

An end view of the brackets 58 is shown in FIG. 8.

The present invention has been described with reference to the preferred embodiment. Obviously, modifications and alterations will occur to others upon a reading and understanding of the specification. It is intended by the applicant to include all such modifications and alterations insofar as they come within the scope of the appended claims or the equivalents thereof.

Having thus described the invention, it is now claimed.

What is claimed is:

1. A deck structure comprising:

a frame, said frame comprising spaced-apart, supporting members;

a plurality of planks comprising plastic material, said planks being closely received transversely to said supporting members, each of said planks having a longitudinal groove formed in the underside thereof and, a plurality of connectors, said connectors protruding from said frame and being fixedly attached thereto, said connectors selectively fitting into said grooves for connecting said planks to said frame so that said planks are slidable relative to said frame in a direction parallel to said grooves.

2. The structure of claim 1 wherein each of said planks comprise a first end, said structure further comprising:

securing means for securing said first end of said plank to said frame.

3. The structure of claim 1 wherein each of said planks comprise an inwardly extending flange, said flange defining flange void on one side of said groove, said flange cooperating with said connectors to prevent displacement of said plank away from said frame in a direction perpendicular to said groove.

4. The structure of claim 3 wherein each of said connectors comprises a base connected at a first end to said frame and connected at a second end to a head portion, said head portion extending in at least one direction at a right angle to said base, said head portion being received in said flange void.

5. The structure of claim 3 wherein:

each of said planks comprises a second inwardly extending flange, said second flange defining a second flange void extending from the other side of said groove; and, each of said connectors comprises a base connected at a first end to said frame and connected at a second end to a head portion, said head portion comprising a crossbar of a T-shaped member, said crossbar being received within said flange voids and being aligned in direction with said supporting members.

6. The structure of claim 1 wherein said supporting members are spaced approximately 12 inches apart.

7. The structure of claim 1 wherein said supporting members are constructed of metal.

8. The structure of claim 1 wherein said supporting members are made of a metal which is resistant to corrosion upon exposure to atmospheric conditions or other man-made materials.

9. The structure of claim 1 wherein said supporting members are made of a metal which includes a coating which makes said metal resistant to corrosion upon exposure to atmospheric conditions.

10. The structure of claim 1 further comprising:

brackets, said brackets fixed to said frame at spaced-apart intervals.

11. The structure of 10 further comprising:

a railing, said railing being secured to said frame at said brackets.

12. The structure of claim 1 wherein said planks are comprised of a coloring agent.

13. The structure of claim 1 wherein said supporting members are made of fiberglass.

14. A connector for use in a decking securement system utilizing associated lumber comprising plastic material, said connector comprising:

a base having a first end fixedly attached to an associated frame, said associated frame being rigid; and, a head, said head being at a second end of said base and extending in at least one direction at right angles to said base, said head capable of slidably fitting within a longitudinal groove formed in the underside thereof in said associated lumber, thereby securing said associated lumber to said associated frame so that said lumber is slidable in relation to said connector in a direction parallel to said groove.

15. The connector of claim 14 wherein said head is a crossbar of a T-shaped element.

16. A method for building a structure of lumber planks, each plank comprising plastic material and having a longitudinal groove formed in the underside thereof and inwardly extending flanges defining flange voids on either side of said groove, said method comprising the steps of:

building a framework comprising spaced-apart, parallel supporting members;

attaching spaced-apart connectors to said supporting members; and, mounting each of said lumber planks transversely to said supporting members by receiving said connectors into said longitudinal groove while sliding said lumber planks over said connectors in a direction parallel to said longitudinal groove.

17. The method of claim 16 further comprising the step of securing a first end of each of said planks to said frame.

18. The method of claim 16 further comprising the steps of:

fixing a plurality of brackets to said frame at spaced-apart intervals; and, fixing railings to said frame at said brackets.

* * * * *